US011344073B2

(12) United States Patent
Tyo-Grooten

(10) Patent No.: US 11,344,073 B2
(45) Date of Patent: May 31, 2022

(54) ARM SLEEVE WITH A TRANSLUCENT WINDOW

(71) Applicant: Melissa Chantelle Tyo-Grooten, New Smyrna Beach, FL (US)

(72) Inventor: Melissa Chantelle Tyo-Grooten, New Smyrna Beach, FL (US)

( * ) Notice: Subject to any disclaimer, the term of this patent is extended or adjusted under 35 U.S.C. 154(b) by 289 days.

(21) Appl. No.: 16/363,923

(22) Filed: Mar. 25, 2019

(65) Prior Publication Data

US 2019/0289935 A1 Sep. 26, 2019

Related U.S. Application Data

(60) Provisional application No. 62/647,035, filed on Mar. 23, 2018.

(51) Int. Cl.
*A41D 27/10* (2006.01)

(52) U.S. Cl.
CPC ..... *A41D 27/10* (2013.01); *A41D 2500/50* (2013.01)

(58) Field of Classification Search
CPC .... A41D 2500/50; A41D 27/10; A41D 13/12; A41D 13/1209; A41D 13/205; G06F 19/3406
USPC ..... 2/69
See application file for complete search history.

(56) References Cited

U.S. PATENT DOCUMENTS

| | | | | |
|---|---|---|---|---|
| 5,924,135 | A | 7/1999 | Worth | |
| D615,280 | S | 5/2010 | Graulich | |
| 2006/0117458 | A1 | 6/2006 | Ishihara et al. | |
| 2011/0185469 | A1 | 8/2011 | Santuccio | |
| 2012/0074184 | A1* | 3/2012 | Morgan | A45F 5/00 224/222 |
| 2013/0300101 | A1* | 11/2013 | Wicker | G07D 7/1205 283/67 |
| 2013/0325648 | A1* | 12/2013 | Kanner | G06Q 30/0621 705/26.5 |
| 2015/0296900 | A1* | 10/2015 | Huang | A41D 27/205 2/114 |

OTHER PUBLICATIONS

Coup De Grace, https://coup-de-grace.net/products/undercoverism-1.

Grailed, https://www.grailed.com/listings/421989-undercover-cotton-m-65-watch-window.

* cited by examiner

*Primary Examiner* — Timothy K Trieu

(57) ABSTRACT

An arm sleeve with a translucent window includes an arm sleeve garment, a wrist opening, and a translucent panel. The arm sleeve garment includes a hand section, a wrist section, and a forearm section. The hand section is terminally connected to the wrist section. The forearm section is terminally connected to the wrist section, opposite of the hand section. The wrist opening is integrated into the wrist section as the wrist opening can be positioned on a posterior panel of the wrist section, an anterior panel of the wrist section, or around the wrist section. The translucent panel is perimetrically connected to the wrist section about the wrist opening, wherein the translucent panel enables operation of a wrist wearable computing device.

13 Claims, 8 Drawing Sheets

ARM SLEEVE WITH A TRANSLUCENT WINDOW

The current application claims a priority to the U.S. Provisional Patent application Ser. No. 62/647,035 filed on Mar. 23, 2018. The current application is filed on Mar. 25, 2018 while Mar. 23, 2018 was on a weekend.

FIELD OF THE INVENTION

The present invention relates generally to arm sleeve garment. More, specifically, the present invention is an arm sleeve garment made with a translucent panel so that wrist wearable computing devices such as smart watches, step counters, and fitness trackers can be viewed and operated without rolling up the arm sleeve garment.

BACKGROUND OF THE INVENTION

In today's age of advanced technology, many people have begun using smart watches, step counters, fitness trackers, and other similar types of wrist wearable computing devices to attain health related information, biomedical data, and mobile device related activities. For example, fitness trackers are able to keep track of an individual's calorie burn a specific timeline. However, one can encounter a problem when completing their fitness routine is that their clothes may inhibit their ability to view or operate a wrist wearable computing device, especially when environment may be colder and additional clothing is needed.

It is an objective of the present invention solves this issue by providing an arm sleeve garment that is translucent around the wrist area. As a result, the present invention allowing an individual to view or operate their wrist wearable computing devices while keeping their arm sleeve garment in place. Furthermore, the arm sleeve garment can be an individual clothing item or integrated onto clothing articles such as body suits, athletic wears, and long sleeve shirts.

DETAIL DESCRIPTIONS OF THE INVENTION

All illustrations of the drawings are for the purpose of describing selected versions of the present invention and are not intended to limit the scope of the present invention.

The present invention is an arm sleeve with a translucent window so that the present invention allows an individual to view or operate their wrist wearable computing devices without rolling up the arm sleeve. The wrist wearable computing device explained hereinafter includes, but is not limited to, a smart watch, a step counter, a fitness tracker, a medical device, a music player, and any other types of wrist worn smart devices. Furthermore, the present invention can be an individual clothing item such as an arm sleeve cover or integrated into an article of clothing 14 such as a body suit, an athletic wear, a long sleeve shirt, and an outer wear. The present invention can be utilized as both mean women arm sleeve as the configuration and the functionality of the present invention are not limiting a specific gender. The present invention can be made as a compression fitting or a loss fitting to accommodate variety of user preferences.

Figure 1:
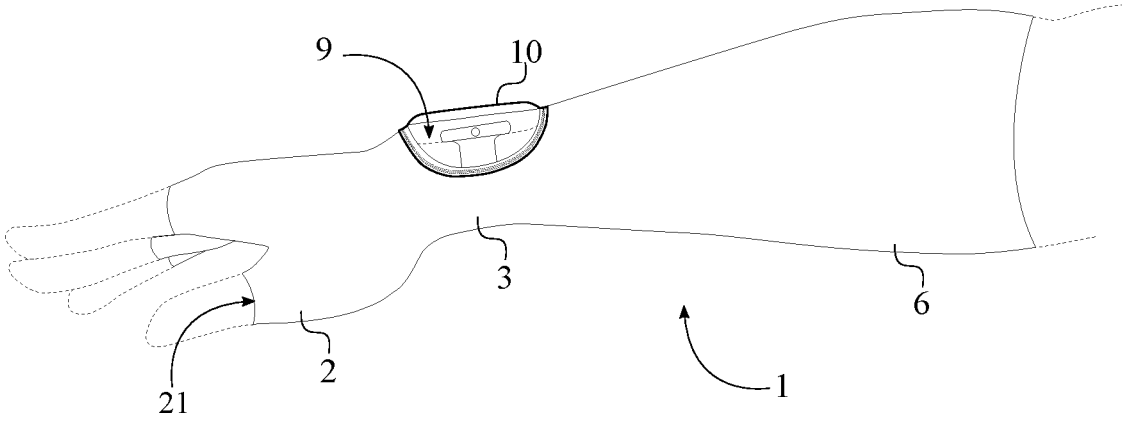
FIG. 1 is a perspective view of the present invention.
Figure 2:
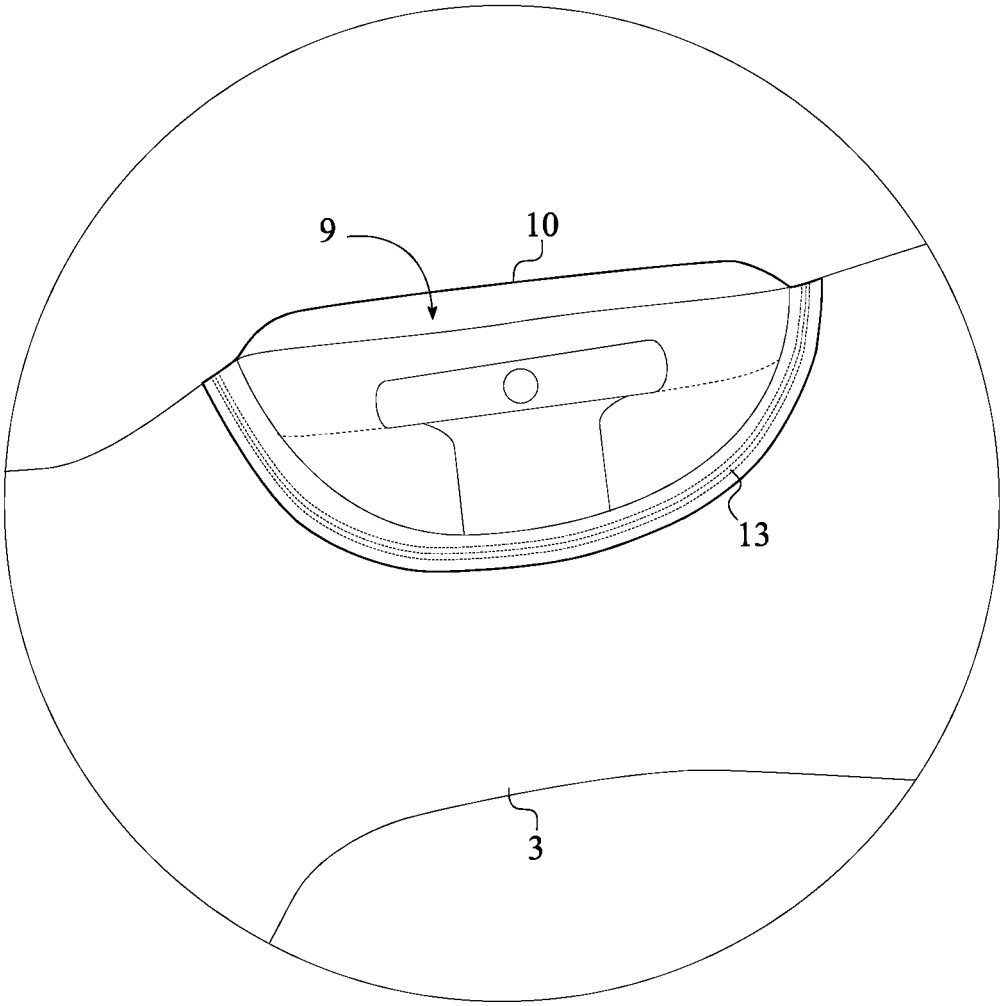
FIG. 2 is a detailed view of the present invention, showing the triple stretch stitching between of the translucent panel.
Figure 8:
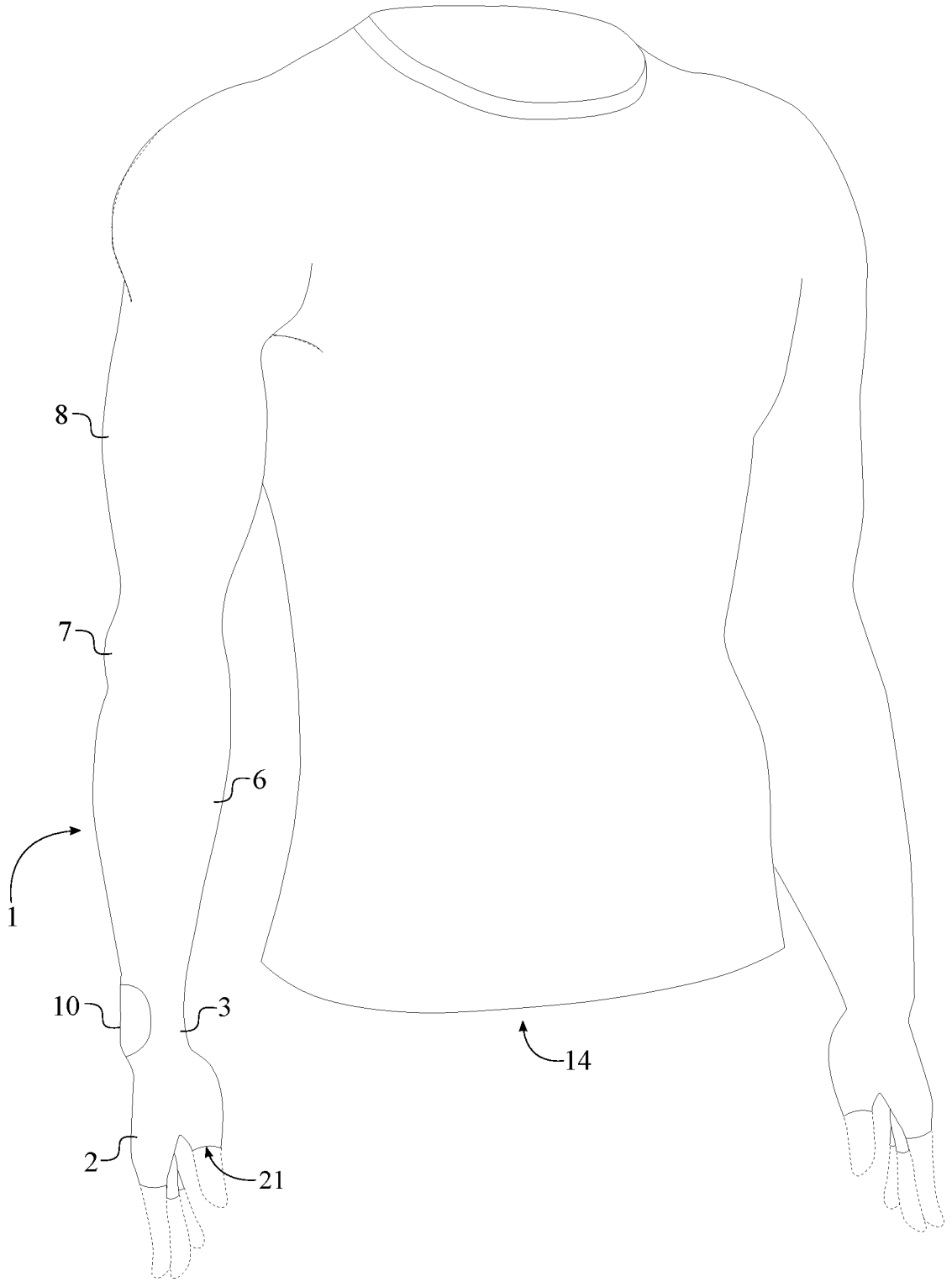
FIG. 8 is a perspective view of the present invention, wherein the present invention is connected to the article of clothing.

In reference to FIG. 1-2, the present invention comprises an arm sleeve garment 1, a wrist opening 9, and a translucent panel 10 as the main components. The arm sleeve garment 1 comprises a hand section 2, a wrist section 3, and a forearm section 6 in order to properly and fashionably cover an individual's arm. The hand section 2, which fully or partially cover the user's hand, is terminally connected to the wrist section 3 as the wrist section 3 generally covers the user's wrist area, More specifically, the hand section 2 comprises a thumb-receiving opening 21 and at least one finger-receiving opening 22, wherein the thumb-receiving opening 21 and the at least one finger-receiving opening 22 are positioned offset from the wrist section 3, and wherein the thumb-receiving opening 21 and the at least one finger-receiving opening 22 are positioned offset from each other. The forearm section 6 that generally covers the user's forearm is terminally connected to the wrist section 3 and positioned opposite of the hand section 2. As a result, the arm sleeve garment 1 is able to extend from the user's hand to the user's forearm thus forming the arm sleeve cover. In reference to FIG. 8, the arm sleeve garment 1 can further comprise an elbow section 7 and an arm section 8 when the arm sleeve garment 1 is integrated onto the article of clothing 14. More specifically, the elbow section 7 is terminally connected to the forearm section 6 and positioned opposite of the wrist section 3. The arm section 8 is terminally connected to the elbow section 7 and positioned opposite of the forearm section 6 thus enabling the arm section 8 to be connected to the article of clothing 14 opposite of the elbow section 7.

In reference to FIG. 1-2, the wrist opening 9 is integrated into the wrist section 3 so that the wrist wearable computing device can be worn within the wrist opening 9, The translucent panel 10 is perimetrically connected to the wrist section 3 about the wrist opening 9 in such a way that the translucent panel 10 enables the operation of the wrist wearable computing device. Depending upon different embodiment of the present invention, the placement of the wrist opening 9 can differ to accommodate different user preferences.

Figure 5:
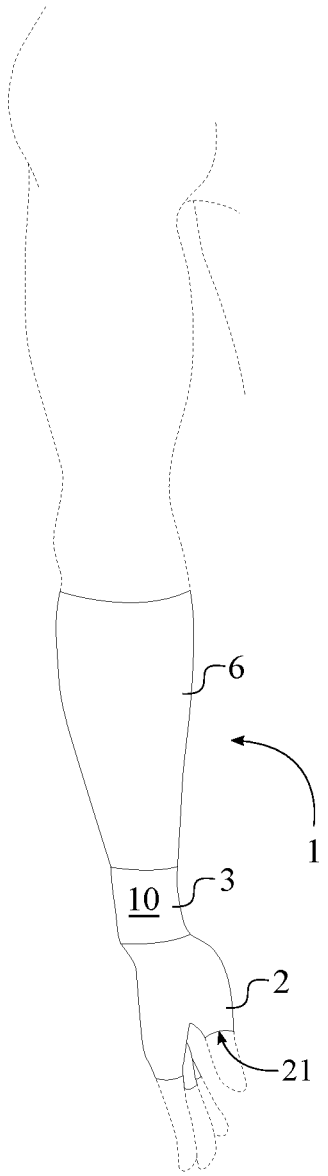
FIG. 5 is a perspective view of the present invention, wherein the wrist section is connected in between the hand section and the forearm section.

In reference to FIG. 5, the wrist opening 9 is delineated by the wrist section 3 within a first embodiment of the present invention. More specifically, the wrist opening 9 circumferencely extends around the wrist section 3 as the wrist section 3 becomes the wrist opening 9. The translucent panel 10 then functions as the connecting member in between the hand section 2 and the forearm section 6. In other words, the translucent panel 10 is perimetrically connected to the hand section 2 and forearm section 6 so that the wrist wearable computing device can be viewed or operated by the user.

Figure 6:
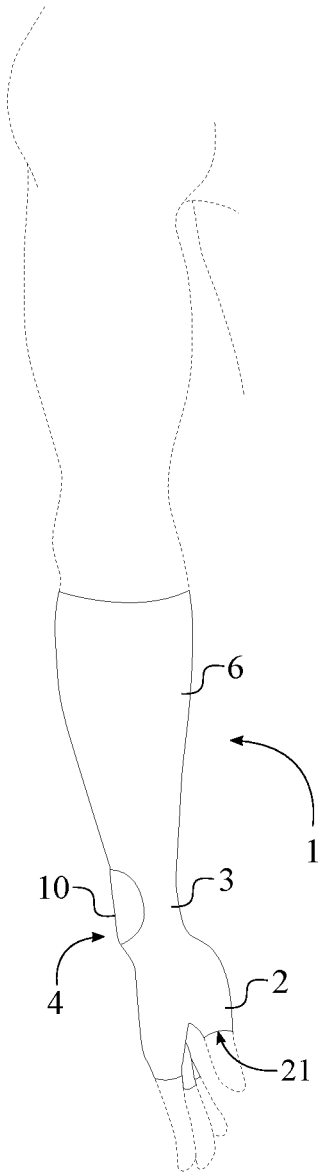
FIG. 6 is a perspective view of the present invention, wherein the wrist section is positioned adjacent to the dorsal panel of the wrist section.

In reference to FIG. 6, the wrist opening 9 is positioned adjacent to an upper section of the wrist section 3 within a second embodiment of the present invention. More specifically, the wrist opening 9 traverses through a dorsal panel 4 of the wrist section 3 as the translucent panel 10 is perimetrically connected to the dorsal panel 4. As a result, the wrist wearable computing device can be viewed or operated by the user in reference to the dorsal body surface of the user's arm.

Figure 7:
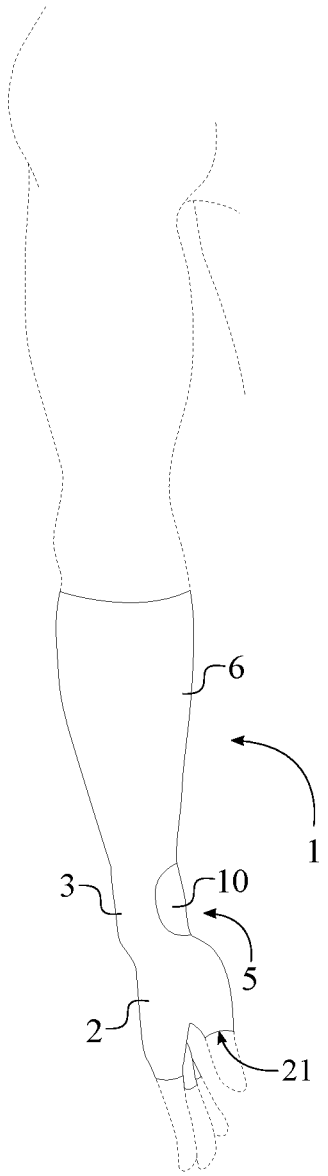
FIG. 7 is a perspective view of the present invention, wherein the wrist section is positioned adjacent to the painter panel of the wrist section.

In reference to FIG. 7, the wrist opening 9 is positioned adjacent to a lower section of the wrist section 3 within a third embodiment of the present invention. More specifically, the wrist opening 9 traverses through a palmer panel 5 of the wrist section 3 as the translucent panel 10 is perimetrically connected to the palmer panel 5. As a result, the wrist wearable computing device can be viewed or operated by the user in reference to the palmer body surface of the user's arm.

The present invention further comprises a triple stretch stitching 13 as shown in FIG. 2. The translucent panel 10 is perimetrically connected to the wrist section 3 by the triple stretch stitching 13 so that the translucent panel 10 is able to withstand constant movements of the user without structurally weakening the present invention.

Figure 3:
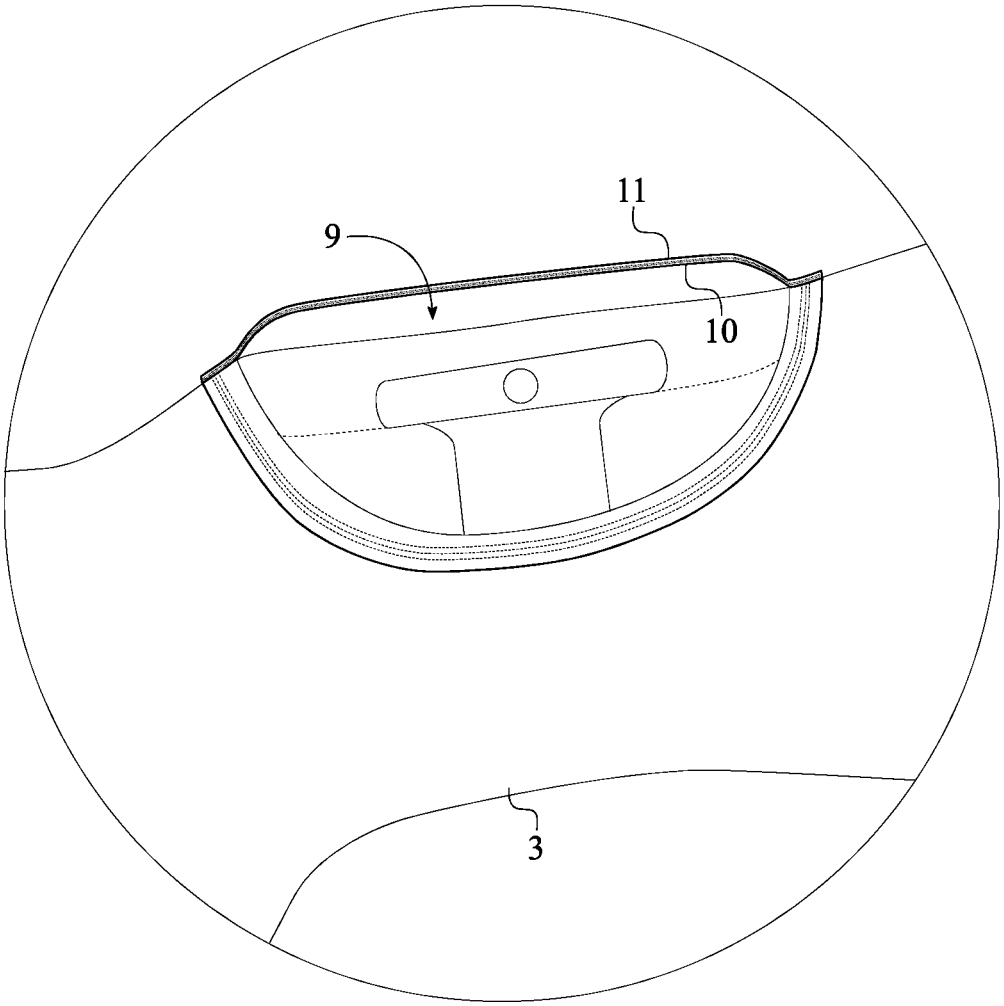
FIG. 3 is a detailed view of the present invention, showing the layer of tint on the translucent panel.

The present invention further comprises a layer of tint 11 as shown in FIG. 3. The layer of tint 11 is superimposed over the translucent panel 10 in order to reduce ultraviolet (UV) radiation and protect sensitive components of the wrist wearable computing device.

Figure 4:
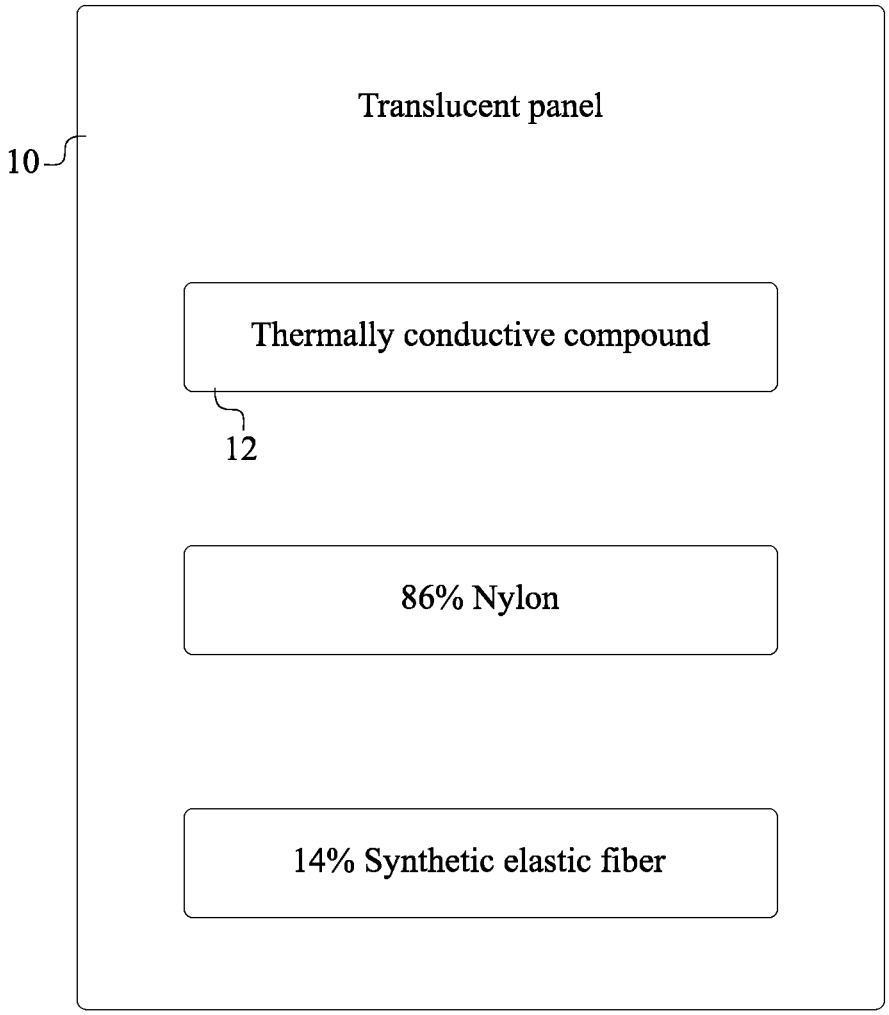
FIG. 4 is a shamanic view of the present invention, showing the thermally conductive compounds and material properties of the translucent panel.

The present invention further comprises a thermally conductive compound 12 as shown in FIG. 4. The thermally conductive compound 12 is impregnated into the translucent panel 10 in order to enable the touch capabilities of specific wrist wearable computing devices.

In reference to FIG. 4, the translucent panel 10 comprises about 86 percent of nylon fiber and about 14 percent of synthetic elastic fiber so that the structural integrity and exceptional elasticity can be attained within the present invention. However, the translucent panel 10 can also be made of any other similar materials that complies with similar material properties.

Although the invention has been explained in relation to its preferred embodiment, it is to be understood that many other possible modifications and variations can be made without departing from the spirit and scope of the invention as hereinafter claimed.

What is claimed is:

1. An arm sleeve with a translucent window comprising:
an arm sleeve garment;
a wrist opening;
a translucent panel;
an article of clothing;
the arm sleeve garment comprises a hand section, a wrist section, a forearm section, an elbow section, and an arm section;
the hand section comprising a thumb-receiving opening and at least one finger-receiving opening;
the hand section being terminally connected to the wrist section;
the thumb-receiving opening and the at least one finger-receiving opening being positioned offset from the wrist section;
the thumb-receiving opening and the at least one finger-receiving opening being positioned offset from each other;
the forearm section being terminally connected to the wrist section, opposite of the hand section;
the wrist opening being integrated into the wrist section;
the translucent panel being perimetrically connected to the wrist section about the wrist opening, wherein the translucent panel enables operation of a wrist wearable computing device;
the elbow section being terminally connected to the forearm section, opposite of the wrist section;
the arm section being terminally connected to the elbow section, opposite of the forearm section;
the arm section being terminally connected the article of clothing, opposite of the elbow section; and
the arm sleeve garment and the article of clothing being a compression fitting.

2. The arm sleeve with a translucent window as claimed in claim 1 comprising:
the wrist opening being delineated by the wrist section; and
the translucent panel being perimetrically connected to the hand section and forearm section.

3. The arm sleeve with a translucent window as claimed in claim comprising:
the wrist section comprises a dorsal panel;
the wrist opening traversing through the dorsal panel; and
the translucent panel being perimetrically connected to the dorsal panel.

4. The arm sleeve with a translucent window as claimed in claim 1 comprising:
the wrist section comprises a paltrier panel;
the wrist opening traversing through the paltrier panel; and
the translucent panel being perimetrically connected to the palmer panel.

5. The arm sleeve with a translucent window as claimed in claim 1 comprising:
a triple stretch stitching; and
the translucent panel being perimetrically connected to the wrist section by the triple stretch stitching.

6. The arm sleeve with a translucent window as claimed in claim comprising:
a layer of tint; and
the layer of tint being superimposed over the translucent panel.

7. The arm sleeve with a translucent window as claimed in claim 1 comprising:
a thermally conductive compound; and
the thermally conductive compound being impregnated into the translucent panel.

8. The arm sleeve with a translucent window as claimed in claim 1 comprising, wherein the translucent panel comprises about 86 percent of nylon fiber and about 14 percent of synthetic elastic fiber.

9. An arm sleeve with a translucent window comprising:
an arm sleeve garment;
a wrist opening;
a translucent panel;
a triple stretch stitching;
a layer of tint;
a thermally conductive compound;
an article of clothing;
the arm sleeve garment comprises a hand section, a wrist section, a forearm section, an elbow section, and an arm section;
the hand section comprising a thumb-receiving opening and at least one finger-receiving opening;
the arm sleeve garment being a compression fitting;
the hand section being terminally connected to the wrist section;

the thumb-receiving opening and the at least one finger-receiving opening being positioned offset from the wrist section;

the thumb-receiving opening and the at least one finger-receiving opening being positioned offset from each other;

the forearm section being terminally connected to the wrist section, opposite of the hand section;

the wrist opening being integrated into the wrist section;

the thermally conductive compound being impregnated into the translucent panel; and the translucent panel being perimetrically connected to the wrist section about the wrist opening, wherein the translucent panel enables operation of a wrist wearable computing device;

the translucent panel being perimetrically connected to the wrist section by the triple stretch stitching;

the layer of tint being superimposed over the translucent panel;

the elbow section being terminally connected to the forearm section, opposite of the wrist section;

the arm section being terminally connected to the elbow section, opposite of the forearm section; and the arm section being terminally connected the article of clothing, opposite of the elbow section.

10. The arm sleeve with a translucent window as claimed in claim 9 comprising:

the wrist opening being delineated by the wrist section; and the translucent panel being perimetrically connected to the hand section and forearm section.

11. The arm sleeve with a translucent window as claimed in claim 9 comprising:

the wrist section comprises a dorsal panel;

the wrist opening traversing through the dorsal panel; and the translucent panel being perimetrically connected to the dorsal panel.

12. The arm sleeve with a translucent window as claimed in claim 9 comprising:

the wrist section comprises a paltrier panel;

the wrist opening traversing through the palmer panel; and the translucent panel being perimetrically connected to the palmer panel.

13. The arm sleeve with a translucent window as claimed in claim 9 comprising, wherein the translucent panel comprises about 86 percent of nylon fiber and about 14 percent of synthetic elastic fiber.

* * * * *